US005586596A

United States Patent [19]

Freeman

[11] Patent Number: 5,586,596

[45] Date of Patent: Dec. 24, 1996

[54] DIE CAST VENT BLOCK

[76] Inventor: Lewis G. Freeman, 1509 Pontiac Dr., Kokomo, Ind. 46902

[21] Appl. No.: 312,308

[22] Filed: Sep. 26, 1994

[51] Int. Cl.[6] ..... B22D 17/14; B22D 17/20

[52] U.S. Cl. ..... 164/253; 164/305

[58] Field of Search ..... 164/254, 253, 164/305, 410

[56] References Cited

U.S. PATENT DOCUMENTS

| | | | |
|---|---|---|---|
| 3,070,857 | 1/1963 | Venus . | |
| 3,590,114 | 6/1971 | Uhlig | 264/328 |
| 4,027,726 | 6/1977 | Hodler | 164/305 |
| 4,099,904 | 7/1978 | Dawson | 425/563 |
| 4,463,793 | 8/1984 | Thurner | 164/155 |
| 4,577,670 | 3/1986 | Moore | 164/155 |
| 4,586,560 | 5/1986 | Ikeya et al. | 164/305 X |
| 4,638,848 | 1/1987 | Yamasaki | 164/305 |
| 4,680,003 | 7/1987 | Schulte et al. | 425/206 |
| 5,101,882 | 4/1992 | Freeman | 164/457 |

FOREIGN PATENT DOCUMENTS

| | | | |
|---|---|---|---|
| 231480 | 12/1960 | Australia | 164/305 |
| 0342872 | 11/1989 | European Pat. Off. | 164/305 |
| 3834777 | 4/1989 | Germany | 164/305 |
| 54-143728 | 11/1979 | Japan | 164/305 |
| 57-81949 | 5/1982 | Japan . | |
| 58-97478 | 6/1983 | Japan . | |
| 63-180354 | 7/1988 | Japan | 164/305 |
| 346361 | 6/1960 | Switzerland . | |
| 471157 | 8/1975 | U.S.S.R. | 164/305 |

*Primary Examiner*—J. Reed Batten, Jr.
*Attorney, Agent, or Firm*—Christopher A. Taravella

[57] ABSTRACT

A die casting vacuum valve system with mating vent blocks which include lands and grooves defining a serpentine path enabling overflow of molten material. The path restricts, stops and prevents further flow of the molten material in the case of an electrical or mechanical malfunction.

18 Claims, 3 Drawing Sheets

Fig-1
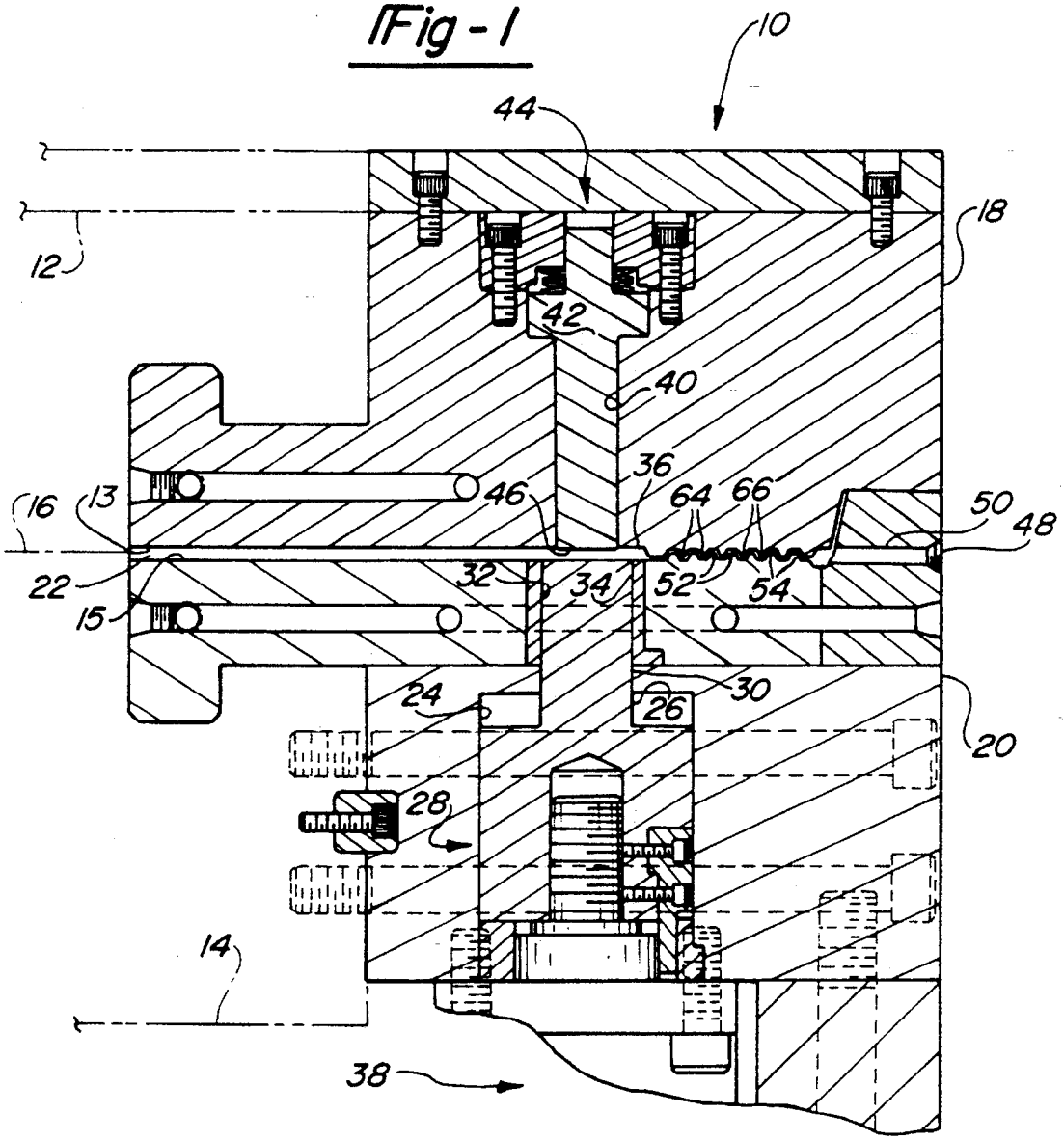
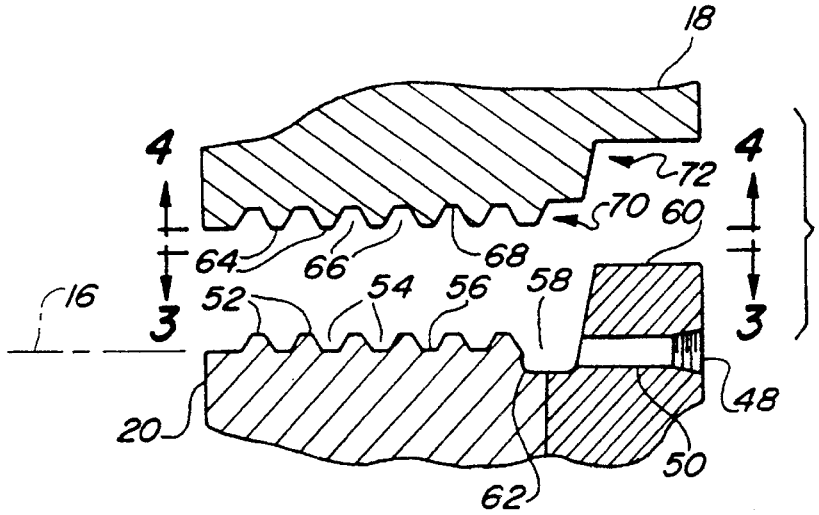
Fig-2

DIE CAST VENT BLOCK

This invention generally relates to die casting vacuum valve systems and, more particularly, to die casting vacuum valve systems with vent blocks.

BACKGROUND AND SUMMARY OF THE INVENTION

Traditionally, in vacuum die casting, it is recommended that air and gases be removed from the casting cavity prior to injection of any molten material. Evacuation of the cavity is generally accomplished by a venting device coupled with the cavity and mold dies. Maximum evacuation results in optimum flow of molten material into the cavity which, in turn, eliminates imperfections in the surface finish and provides for improved casting.

The present invention relates to a new and improved die cast vent block which provides additional protection to the venting passageway in a die casting vacuum valve system. These inventive die cast vent blocks are included in a die cast vacuum valve system adapted to be coupled with a casting die pair or integrated with the die blocks in a vacuum casting apparatus. Typically, a vacuum casting apparatus has an electrical or mechanical shut-off member which prevents the flow of molten material past a certain point. In the present invention, if an electrical or mechanical malfunction occurs and the shut-off member does not shift to the closed position to prevent the flow of molten material, the molten material will flow into the die cast vent blocks in a serpentine, tortuous path, cool and eventually stop. Thus, the present invention provides a die cast vent block which efficiently and effectively prevents the flow of molten material into a venting passageway when an electrical or mechanical shut-off member malfunctions, enabling the die cast vacuum valve system to operate more efficiently, producing improved castings.

Vent blocks are normally ineffective during production by themselves since there is no way to remove molten material particles or flash after each shot of molten material. Therefore, it is a further object of the present invention to provide a die cast vent block which requires a minimum amount of time and effort to maintain, enabling machine shut-down time to be limited.

The above is only one example, and a die cast vent block in accordance with the present invention may have many varied uses. These, and other objects and advantages of the invention over the existing prior art forms, will become apparent from a reading of the following brief description in accordance with the attached drawings.

BRIEF DESCRIPTION OF THE DRAWINGS

FIG. 1 is a cross-sectional view of a die cast vacuum valve system in accordance with the present invention;

FIG. 2 is a cross-sectional view of the die cast vent blocks of FIG. 1;

DETAILED DESCRIPTION OF THE PREFERRED EMBODIMENT

Figure 3:
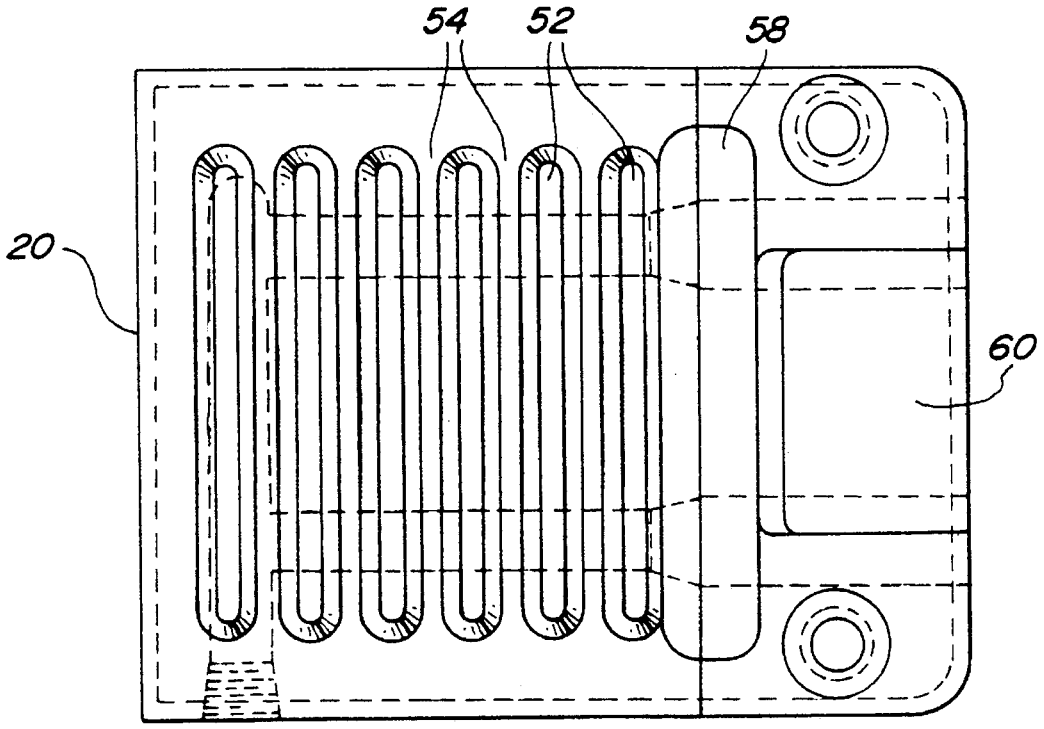
FIG. 3 is a detailed plan view of the ejector vent block of FIG. 2 along line 3—3 showing elongated elliptical lands and grooves.

Referring now to the drawings, there is depicted a die cast vacuum valve system embodying the concept of the present invention. The die cast vacuum valve system 10 is associated with a die set including a cover die 12 and ejector die 14 as illustrated partially in phantom in FIG. 1. Cover die 12 and ejector die 14 include and form the mold cavity (not shown). The cavity (not shown) is separated by a parting line 16. Adjacent surfaces 13 and 15 define parting line 16.

The vacuum valve system 10 has two halves, a cover vent block 18, connected to the cover die 12, and an ejector vent block 20, coupled with the ejector die 14. These two vent blocks 18 and 20 form the housing of the vacuum valve system 10. As can be seen in FIG. 1, the cover vent block 18 and ejector vent block 20 are generally rectangular. Optionally, cover vent block 18 and ejector vent block 20 may be built into cover die 12 and ejector die 14, respectively, and a unitary part thereof. Cover vent block 18 and ejector vent block 20 will have a gas flow rate of 0.105 in.$^2$ (0.030 in. deep×3.500 in. wide=0.105 in.$^2$).

The ejector vent block 20 includes a slot or notch 22 enabling an overflow runner to be formed therein when the cavity is filled with molten material. The ejector vent block 20 also includes an enlarged counter-sunk bore 24 which houses the shut-off piston 26 and the shut-off piston assembly 28, a passageway 30 and a bore 32 which provides passage for the shut-off piston 26. A bushing 34 is located in the bore 32. The cover vent block 18 also includes an overflow trough 36 which provides an access area if the shut-off piston 26 does not pinch off the flow of molten material along slot 22 in time. Thus, cover vent block 18 provides an area for overflow of molten material. A hydraulic cylinder assembly 38 (not shown) or the like, moves the shut-off piston 26 within bore 32.

The cover vent block 18 includes a central bore 40 which houses cushion piston 42 and cushion piston assembly 44. The cushion piston 42 has a portion 46 that extends beyond the surface 13 of the cover vent block 18 as seen in FIG. 1. This portion 46 of cushion piston 42 is in its first resting or original position extending beyond the surface 13 of the cover vent block 18 when the cushion piston 42 is loaded and secured in cover vent block 18. Cushion piston 42 is contacted by the shut-off piston 26 when the shut-off piston 26 is closed in response to molten material entering the cavity. The cushion piston 42 cushions the shut-off piston 26 as it tightly clamps and closes the parting line 16 at the slot 22. As the shut-off piston 26 actuates upward, the cushion piston 42 moves upward such that the portion 46 of the cushion piston 42 becomes flush with the surface 13 of the cover vent block 18. At this time, the shut-off piston 26 contacts the surface 13 of the cover vent block 18 peripherally about the cushion piston 42 sealing the shut-off piston 26 with the cover vent block 18 to terminate the flow of molten material through slot 22. Once the shut-off piston 26 is removed from contact with the cushion piston 42, the cushion piston 42 returns to its normal or original position where portion 46 of the cushion piston 42 extends from the surface 13 of the cover vent block 18.

Vacuum valve system 10 also includes a vacuum port 48 opening into a venting passage 50. Vacuum port 48 and venting passage 50 are disposed at parting line 16. A vacuum system (not shown) is adapted to be coupled with the vacuum port 48 to draw air and fluid from the cavity through vacuum valve system 10. The vacuum is drawn through vacuum valve system 10 via slot 22, overflow trough 36 and venting passage 50 while the shut-off piston 26 is out of contact with the cushion piston 42.

The piston shut-off assembly 28, hydraulic cylinder assembly 38 and cushion piston assembly 44 may be like that disclosed in U.S. Pat. No. 5,101,882 or like those in U.S. application Ser. No. 08/312,309 entitled Die Cast Vacuum Valve and U.S. application Ser. No. 08/312,324 entitled Die Cast Vacuum Valve, both filed on Sep. 26, 1994, the specification and drawings of which all are expressly incorporated by reference.

As shown in FIG. 1 and FIG. 2, ejector vent block 20 further includes a set of lands 52 and grooves 54. Lands 52 and trapezoidal grooves 54 are disposed above parting line 16. Lower surfaces 56 of the trapezoidal grooves 54 are disposed at parting line 16. Lands 52 and lower surfaces 56 of trapezoidal grooves 54 are parallel to each other and parting line 16. As shown in FIG. 3, lands 52 and trapezoidal grooves 54 are adjacent, alternate and extend substantially across ejector vent block 20 as elongated ellipses.

Ejector vent block 20 also includes slot 58 and plug 60 which are in lateral communication with each other, and lands 52 and trapezoidal grooves 54. Slot 58 extends downward and is disposed below parting line 16, and has a lower surface 62. Lower surface 62 of slot 58 is parallel to parting line 16, and lands 52 and lower surfaces 56 of trapezoidal grooves 54. Plug 60 extends upward and is disposed above parting line 16.

Figure 4:
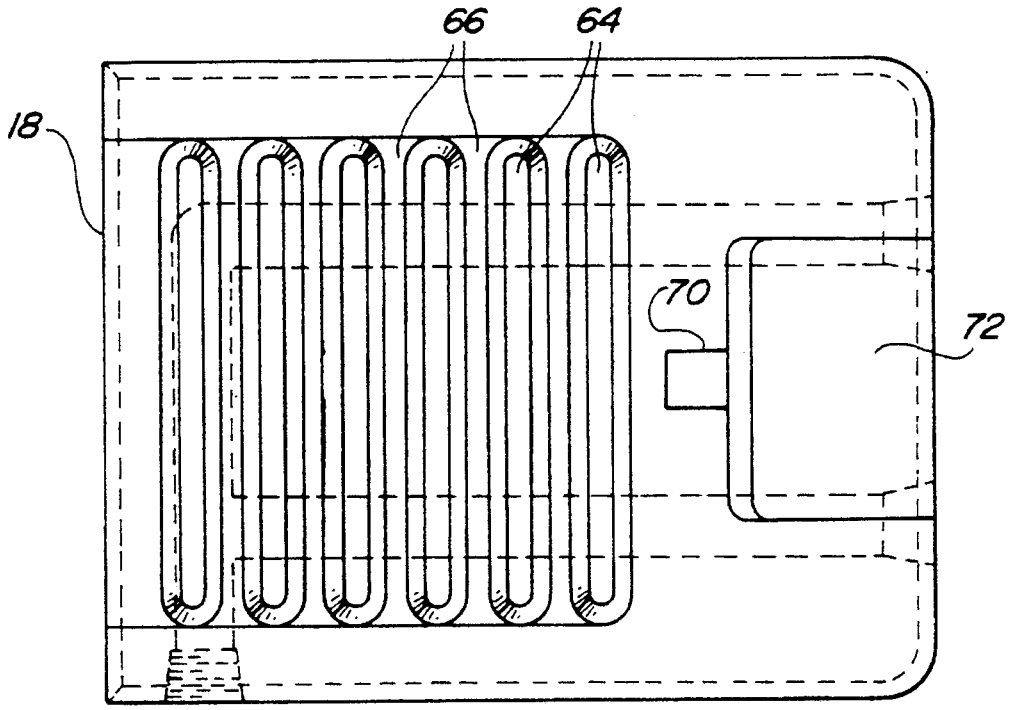
FIG. 4 is a detailed plan view of the cover vent block of FIG. 2 along line 4—4 showing elongated elliptical lands and grooves.

As shown in FIG. 1 and FIG. 2, cover vent block 18 also includes a complimentary set of lands 64 and grooves 66. Lands 64 are disposed at parting line 16 when the die pair is closed, while trapezoidal grooves 66 are disposed above parting line 16. Upper surfaces 68 of trapezoidal grooves 66 are also disposed above parting line 16. Lands 64 and upper surfaces 68 of trapezoidal grooves 66 are parallel to each other and parting line 16. As shown in FIG. 4, lands 64 and trapezoidal grooves 66 are adjacent, alternate and extend substantially across cover vent block 18 as elongated ellipses.

Cover vent block 18 also includes key 70 and slot 72 which are in lateral communication with each other, and lands 64 and trapezoidal grooves 66. Key 70 and slot 72 both extend inward away from parting line 16.

A heat sensor may also be associated with vacuum valve system 10 in order to detect heat in the material flow areas or some type of malfunction. Should excess heat in the material flow areas be detected or some type of malfunction exist, the machine will shut-down. During this shut-down time, the machine operator will be allowed to clean cover vent block 18 and ejector vent block 20 before the next shot of molten material is introduced. A complete explanation of the vacuum casting process is thoroughly shown and disclosed in U.S. Pat. No. 5,101,882.

In operation, if for any reason there is an electrical or mechanical malfunction and the shut-off piston 26 and the cushion piston 42 fail to seal at parting line 16, enabling the flow of molten material to continue past this point, the molten material will flow into the set of lands 52 and grooves 54 of ejector vent block 20 and the complimentary set of lands 64 and grooves 66 of cover vent block 18. This will force the molten material to flow in a serpentine, tortuous path, enabling the molten material to cool, solidify and stop. As cover vent block 18 and ejector vent block 20 come together, lands 52 and grooves 54 of ejector vent block 20 mate with lands 64 and grooves 66 of cover vent block 18. Lands 52 engage upper surfaces 68 of trapezoidal grooves 66 while lower surfaces 56 of trapezoidal grooves 54 engage lands 64.

After the mating vent blocks cool, solidify, stop and prevent the further flow of molten material, the die cast apparatus will complete its cycle, open and eject the formed casting, which still should be in good condition. While the die cast apparatus remains shut-down until the malfunction is solved, the operator can clean and ready cover vent block 18 and ejector vent block 20 for the next shot of molten material.

Figure 5:
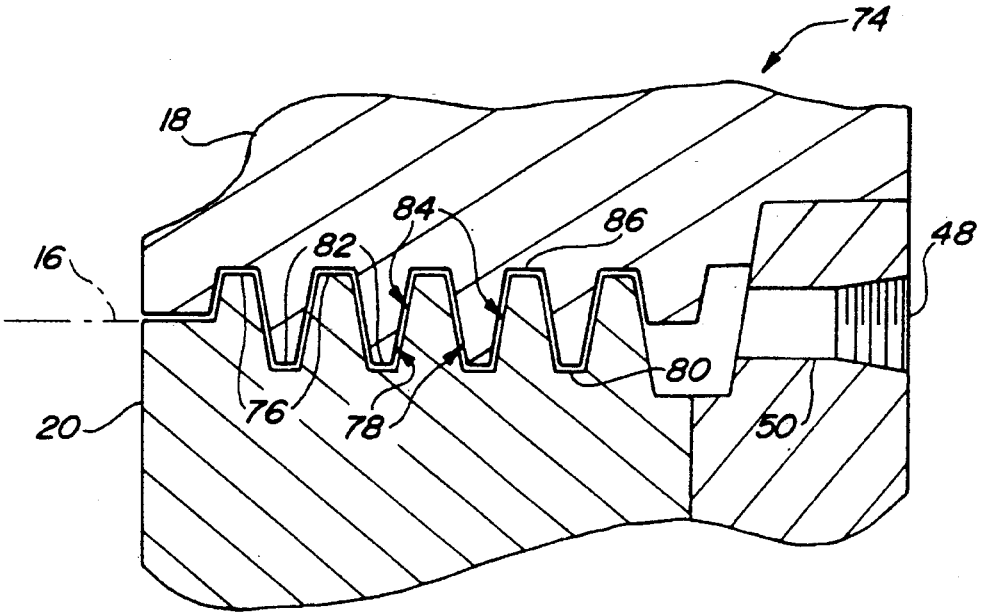
FIG. 5 illustrates a cross-sectional view of an alternate embodiment of the die cast vent blocks in accordance with the present invention.

Shown in FIG. 5 is a second embodiment of die cast vent blocks 74 in accordance with the present invention. Like reference numbers will be used to identify like components. In this embodiment, ejector vent block 20 includes a set of lands 76 and grooves 78. Lands 76 are offset with respect to parting line 16. Trapezoidal grooves 78 have lower surfaces 80. Lower surfaces 80 of trapezoidal grooves 78 are offset with respect to parting line 16. Lands 76 and lower surfaces 80 of trapezoidal grooves 78 are parallel to each other and parting line 16. The offset may be above or below parting line 16.

Moreover, in this embodiment, cover vent block 18 includes a complimentary set of lands 82 and grooves 84. Lands 82 are offset with respect to parting line 16. Trapezoidal grooves 84 have upper surfaces 86. Upper surfaces 86 of trapezoidal grooves 84 are offset with respect to parting line 16. Lands 82 and upper surfaces 86 of trapezoidal grooves 84 are parallel to each other and parting line 16. The offset may be above or below parting line 16.

Lands 76 and grooves 78 of ejector vent block 20 mate with lands 82 and grooves 84 of cover vent block 18. Lands 76 engage upper surfaces 86 of trapezoidal grooves 84 while lower surfaces 80 of trapezoidal grooves 78 engage lands 82. Again, these mating vent blocks force molten material to flow in a serpentine, tortuous path, enabling the molten material to cool, solidify and stop.

This embodiment results in a more restrictive, efficient and effective die cast vent block apparatus thereby enhancing the performance of this device. The die cast vacuum valve system of this embodiment operates substantially the same as that of the die cast vacuum valve system 10 previously described.

Figure 6:
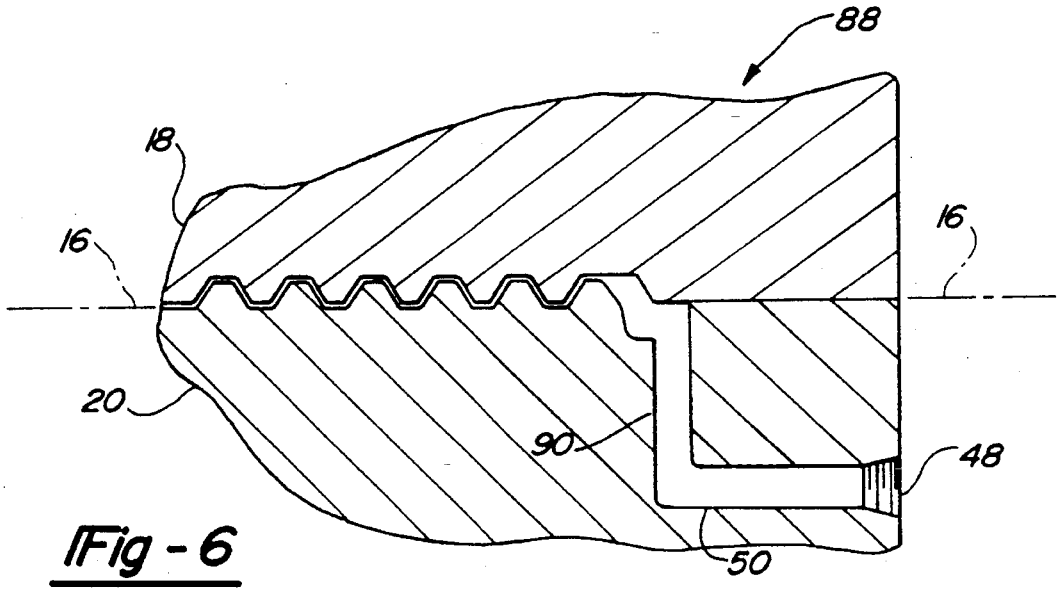
FIG. 6 illustrates a cross-sectional view of a second alternate embodiment of the die cast vent blocks in accordance with the present invention.

Shown in FIG. 6 is a third embodiment of die cast vent blocks 88 in accordance with the present invention. Like reference numbers will again be used to identify like components. In this embodiment, cover vent block 18 and ejector vent block 20 include lands and grooves as previously described and shown in FIGS. 1–4. The mating lands and grooves shown in FIG. 6 are disposed above parting line 16.

Moreover, in this embodiment, ejector vent block 20 includes vacuum port 48 and venting passage 50, which are both disposed below parting line 16. Venting passage 50 is in communication with and opens into a second venting passage 90. Second venting passage 90 is perpendicular to venting passage 50 and disposed in cover vent block 18 and ejector vent block 20.

The die cast vacuum valve system of this embodiment also operates substantially the same as that of the die cast vacuum valve system 10 previously described.

While the above detailed descriptions describe the preferred embodiment of the present invention, it will be understood that the present invention is susceptible to modification, variation and alteration without deviating from the scope and fair meaning of the subjoined claims.

What is claimed is:

1. A vacuum valve device in combination with a die pair comprising:

a first and a second die having a cavity and defining a parting line;

an ejector die block adapted to be coupled with said first die and including a slot adapted for enabling flow of a molten material from said cavity;

a shut-off piston disposed within said ejector die block;

a cover die block adapted to be coupled with said second die;

a complimentary surface for said shut-off piston disposed within said cover die block;

vent block means for preventing flow of said molten material, said vent block means including a first vent block having a plurality of lands and an alternating plurality of grooves, adjacent lands and grooves forming an overall oval shape when viewed in plan;

a second vent block having a plurality of lands and an alternating plurality of grooves, adjacent lands and grooves forming an overall oval shape when viewed in plan, a parting line defined by said first and second vent blocks, wherein said first and second blocks mate with one another to define a serpentine path, in cross-section, which path enables overflow of molten material to flow in and out of the parting line as well as to cool, solidify and stop; and control means for controlling said shut-off piston.

2. A vacuum valve device in combination with a die pair as set forth in claim 1 wherein said vent block means includes an ejector vent block adapted to be coupled with said first die and a cover vent block adapted to be coupled with said second die, said ejector vent block and cover vent block defining said serpentine path.

3. A vacuum valve device in combination with a die pair as set forth in claim 1 wherein said land of said ejector vent block is disposed above the parting line and a bottom surface of said groove of said ejector vent block is disposed substantially on the parting line.

4. A vacuum valve device in combination with a die pair as set forth in claim 1 wherein said land and said groove of said ejector vent block, and said land and said groove of said cover vent block are disposed above the parting line.

5. A vacuum valve device in combination with a die pair as set forth in claim 1 wherein said land and said groove of said ejector vent block, and said land and said groove of said cover vent block are offset with respect to the parting line.

6. A vacuum valve device in combination with a die pair as set forth in claim 1 further comprising:

a venting system in communication with said mating vent blocks.

7. A vacuum valve device in combination with a die pair as set forth in claim 6 wherein said land of said ejector vent block is disposed above the parting line and a bottom surface of said groove of said ejector vent block is disposed substantially on the parting line.

8. A vacuum valve device in combination with a die pair as set forth in claim 6 wherein said land and said groove of said ejector vent block, and said land and said groove of said cover vent block are disposed above the parting line.

9. A vacuum valve device in combination with a die pair as set forth in claim 6 wherein said land and said groove of said ejector vent block, and said land and said groove of said cover vent block are offset with respect to the parting line.

10. A vacuum valve device in combination with a die pair as set forth in claim 6 wherein said plurality of lands of said ejector vent block are disposed above the parting line and a bottom surface of said plurality of grooves of said ejector vent block are disposed substantially on said parting line.

11. A vacuum valve device in combination with a die pair as set forth in claim 6 wherein said plurality of lands and said plurality of grooves of said ejector vent block, and said plurality of lands and said plurality of grooves of said cover vent block are disposed above the parting line.

12. A vacuum valve device in combination with a die pair as set forth in claim 6 wherein said plurality of lands and said plurality of grooves of said ejector vent block, and said plurality of lands and said plurality of grooves of said cover vent block are offset with respect to the parting line.

13. A vacuum valve device in combination with a die pair as set forth in claim 11 wherein said venting system is disposed below the parting line.

14. A vent block for a vacuum valve comprising:

a first vent block having a plurality of lands and an alternating plurality of grooves, adjacent lands and grooves forming an overall oval shape when viewed in plan;

a second vent block having a plurality of lands and an alternating plurality of grooves, adjacent lands and grooves forming an overall oval shape when viewed in plan, a parting line defined by said first and second vent blocks, wherein said first and second vent blocks mate with one another to define a serpentine path, in cross-section, which path enables overflow of molten material to flow in and out of the parting line as well as to cool, solidify and stop; and a venting system in communication with said first and second vent blocks.

15. A vent block as set forth in claim 14 wherein said plurality of lands of said first vent block are disposed above the parting line and a bottom surface of said alternating plurality of grooves of said first vent block are disposed substantially on the parting line.

16. A vent block as set forth in claim 14 wherein said plurality of lands and said alternating plurality of grooves of said first vent block, and said plurality of lands and said alternating plurality of grooves of said second vent block are disposed above the parting line.

17. A vent block as set forth in claim 14 wherein said plurality of lands and said alternating plurality of grooves of said first vent block, and said plurality of lands and said alternating plurality of grooves of said second vent block are offset with respect to the parting line.

18. A vent block as set forth in claim 16 wherein said venting system is disposed below the parting line.

* * * * *